US008992280B2

(12) United States Patent
Tanous

(10) Patent No.: US 8,992,280 B2
(45) Date of Patent: Mar. 31, 2015

(54) FLYING TOY FIGURE

(71) Applicant: Tanous Works, LLC, Simpsonville, SC (US)

(72) Inventor: Gregory David Tanous, Forest Grove, OR (US)

(73) Assignee: Tanous Works, LLC, Simpsonville, SC (US)

( * ) Notice: Subject to any disclaimer, the term of this patent is extended or adjusted under 35 U.S.C. 154(b) by 99 days.

(21) Appl. No.: 13/933,242

(22) Filed: Jul. 2, 2013

(65) Prior Publication Data

US 2013/0288559 A1 Oct. 31, 2013

Related U.S. Application Data

(63) Continuation of application No. 13/869,644, filed on Apr. 24, 2013.

(60) Provisional application No. 61/649,893, filed on May 21, 2012.

(51) Int. Cl.

| | |
|---|---|
| ***A63H 27/00*** | (2006.01) |
| *B64C 27/26* | (2006.01) |
| *A63H 30/04* | (2006.01) |

(52) U.S. Cl.

CPC ..... *A63H 27/00* (2013.01); *A63H 30/04* (2013.01)

USPC ..... 446/57; 446/58; 244/7 A

(58) Field of Classification Search

USPC ..... 446/57, 58, 61, 63, 454, 455, 456; 244/7 A, 7 B, 7 C, 12.4, 48, 56

See application file for complete search history.

(56) References Cited

U.S. PATENT DOCUMENTS

| | | | | |
|---|---|---|---|---|
| 1,791,366 | A | 2/1931 | Markowitz | |
| 1,852,927 | A | 4/1932 | Hall | |
| 2,511,025 | A * | 6/1950 | Tucker et al. | 244/7 A |
| 3,937,424 | A | 2/1976 | Meier et al. | |
| 5,045,112 | A * | 9/1991 | Lehto | 75/499 |

(Continued)

FOREIGN PATENT DOCUMENTS

WO WO 2007/090156 8/2007

OTHER PUBLICATIONS

Mojo Fly, R/C Ironman YouTube. Feb. 19, 2012 Retrieved from internet: http://www.youtube.com/watch?v=VBAohKCrjTY.

(Continued)

*Primary Examiner* — Kien Nguyen

(74) *Attorney, Agent, or Firm* — Stephen E. Kelly; Rogers Towers, P.A.

(57) ABSTRACT

A remote controlled flying toy figure has a thrust-powered, weight shifting rudder head. The flying toy figure comprises a head, a body, a propulsion system, and a control system. The head is attached to the body by a flexible support member, making the head securely fixed in flexible relation to the body, thus permitting a yawing motion of the head relative to the body.

The propulsion system comprises two independently operable motorized propellers, each of which is attached to opposite ends of a steering bar. The steering bar and head form an integral steering unit. Increasing the thrust from one of the propellers causes the figure to turn in the opposite direction. This increased thrust causes the steering bar to yaw, which moves the center of gravity of the head to the opposite side of the center line of the body, which causes the figure to bank towards the turn.

20 Claims, 10 Drawing Sheets

(56) References Cited

U.S. PATENT DOCUMENTS

| | | | | |
|---|---|---|---|---|
| 5,087,000 | A | 2/1992 | Suto | |
| 5,741,168 | A | 4/1998 | Chen | |
| 5,906,335 | A | 5/1999 | Thompson | |
| 5,947,785 | A | 9/1999 | Bausch | |
| 6,609,945 | B2 | 8/2003 | Jimenez et al. | |
| 6,612,893 | B2 * | 9/2003 | Rehkemper et al. | 446/34 |
| 7,275,973 | B2 | 10/2007 | Ong | |
| 7,918,707 | B2 | 4/2011 | Amireh et al. | |
| 7,997,526 | B2 * | 8/2011 | Greenley | 244/7 B |
| 8,133,089 | B2 | 3/2012 | Amireh et al. | |
| 8,330,583 | B2 | 12/2012 | Beard et al. | |
| 8,348,714 | B2 | 1/2013 | Newton et al. | |
| 2003/0197092 | A1 | 10/2003 | Tian et al. | |
| 2005/0151023 | A1 | 7/2005 | Ribbe | |
| 2005/0191930 | A1 | 9/2005 | Foster et al. | |
| 2007/0037468 | A1 | 2/2007 | Ong | |
| 2008/0290691 | A1 | 11/2008 | Corsiglia et al. | |
| 2009/0124162 | A1 | 5/2009 | Martino | |
| 2009/0305599 | A1 | 12/2009 | Newton et al. | |
| 2010/0330866 | A1 * | 12/2010 | Suzuki | 446/57 |

OTHER PUBLICATIONS

Spadflyer. RC Superhero YouTube. Oct. 10, 2010 Retrieved from internet: http ://www.youtube.com/watch?v=2ktqTnwCZZI.

* cited by examiner

FLYING TOY FIGURE

CROSS-REFERENCE TO RELATED APPLICATION

This application is a continuation of United States utility patent application Ser. No. 13/869,644, filed on Apr. 24, 2013, which claims priority to United States provisional patent application Ser. No. 61/649,893, filed on May 21, 2012, the entire contents of both of which are incorporated herein by this reference.

BACKGROUND OF THE INVENTION

1. Field of the Invention

The present invention relates generally to the field of remote controlled flying toys, and more particularly, to a control and steering system for flying toy figures.

2. Description of Related Art

Past flying toy figures are driven by a single propeller, or by two propellers in fixed relation to the body of the figure. As a result, these flying toys can be difficult to control and maneuver during flight. With this loss of control, these toys often fly out of the range of the radio controller, causing the toy to crash.

The present invention seeks to overcome these problems by providing a steering and propulsion system that is retained in flexible relation to the main body of the flying toy figure, thereby enhancing control and performance of the figure during flight.

SUMMARY OF THE INVENTION

The flying toy figure comprises a head flexibly connected to a body, a propulsion system, and a control system. The body comprises one or more wing members and one or more side members. Various embodiments of the body include the combination of top wings, bottom wings, intermediate wings, and lateral wings that are joined together to form the body of the flying toy figure. The head of the figure is connected to the body by a flexible support member. For example, the flexible support member could be a wire or resilient plastic member attaching the body to the head.

The propulsion system generally comprises two or more propulsion units. In most embodiments of the propulsion system, each propulsion unit is an electric motor that drives a propeller. At least two propulsion units are attached to opposite ends of a steering bar. The steering bar is securely attached to the head such that the head and steering bar move as a single unit. The control system, comprises a receiver, a power source such as a battery, a circuit board, and other electronic components and wiring necessary to create electrical connectivity between the receiver, the power source, and the electrical motors that drive the propellers.

During flight operation, the propulsion units are independently driven to promote a greater degree of steering and control by the user. The user uses a wireless control device to send a signal to the receiver of the control system to allocate more power to one of the two propulsion units, thereby creating greater thrust on one side of the body, which forces the flying toy figure to turn to in the opposite direction. Since the head and steering bar unit is attached to the body by a flexible support member, the thrust differential between the propulsion units causes the head to move in a yawing motion relative to the body.

In a common embodiment of the flying toy figure, the control system is mounted to the head, moving weight to the head portion of the flying toy figure. During the yawing motion, the center of gravity of the head moves to the right or left of the longitudinal axis of the figure, thereby causing the figure to bank while turning. The banking motion promotes greater control and maneuverability of the figure during flight.

DETAILED DESCRIPTION OF THE INVENTION

Figure 1:
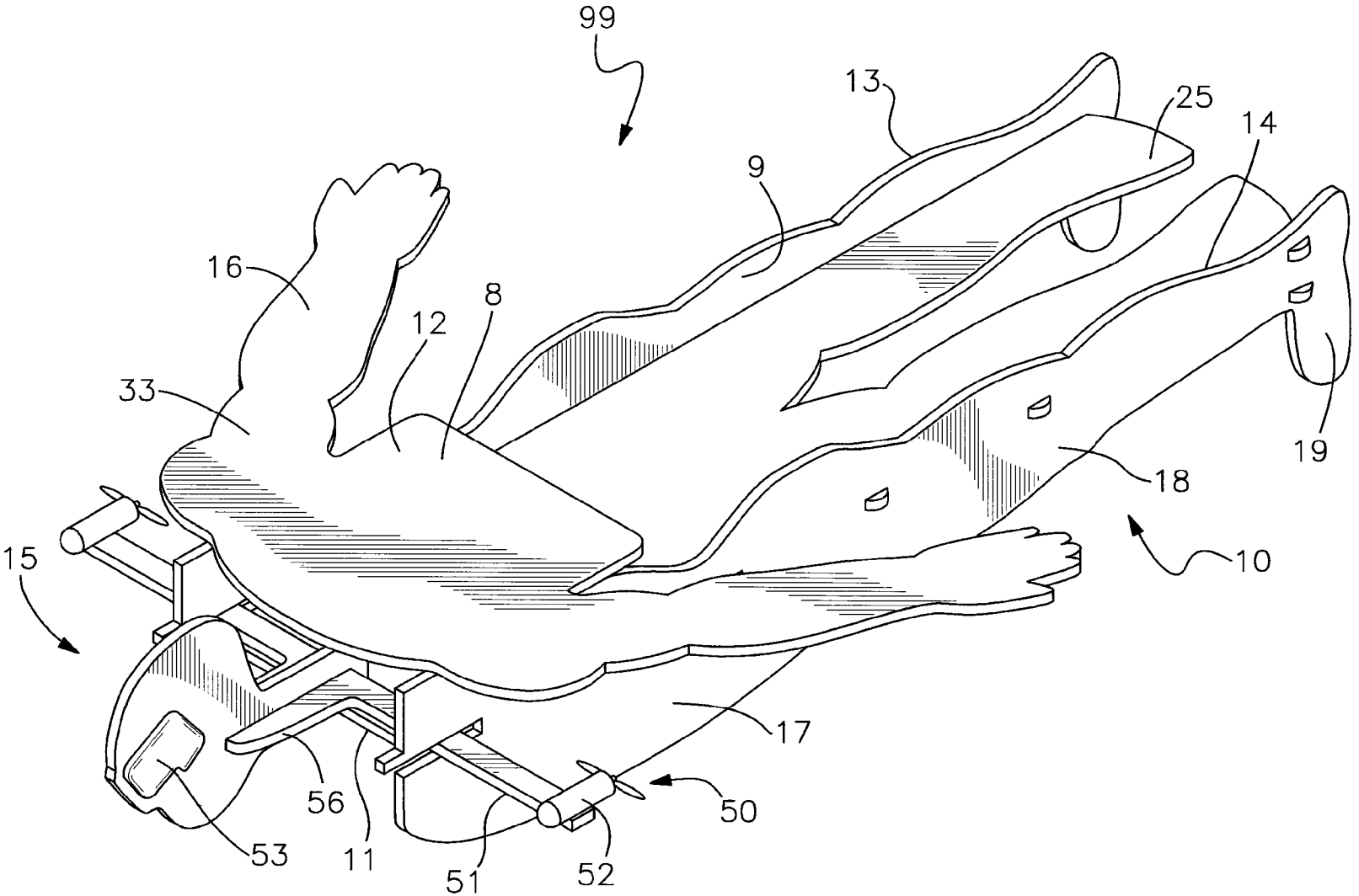
FIG. 1 shows one embodiment of the remote controlled flying toy figure.

With reference to the drawings, the invention will now be described with regard for the best mode and the preferred embodiment. In general, the device is a remote controlled, flying toy figure having a head, a body in the shape of a recognizable figure, a propulsion system, and a control system. The embodiments disclosed herein are meant for illustration and not limitation of the invention. An ordinary practitioner will understand that it is possible to create many variations of the following embodiments without undue experimentation.

The flying toy figure 99 is generally controlled by a wireless control device 5 having a transmitter to transmit an electronic signal to the control system 53 of the flying toy figure 99. The control system 99 controls the propulsion system 50 on the flying toy figure 99 to produce a gliding form of flight, as discussed below. As used herein, the terms "right," "left," "forward," "rearward," "top," "bottom," and similar directional terms refer to orientations when facing the direction of flight of the toy figure. The term "horizontal" means a plane generally parallel to the ground or other surface above which the flying toy figure 99 is flying. The term "vertical" means the direction generally perpendicular to the ground or other surface above which the flying toy figure 99 is flying. The term "electronic signal" means any wireless electromagnetic signal transmitted from the wireless control device 5 to the control system 53 for controlling the flying toy figure 99. In the most common embodiment, the electronic signal is a radio frequency signal typical for radio controlled (RC) toys. The term "longitudinal axis" of the flying toy figure refers to the axis about which the figure rolls.

Figure 2:
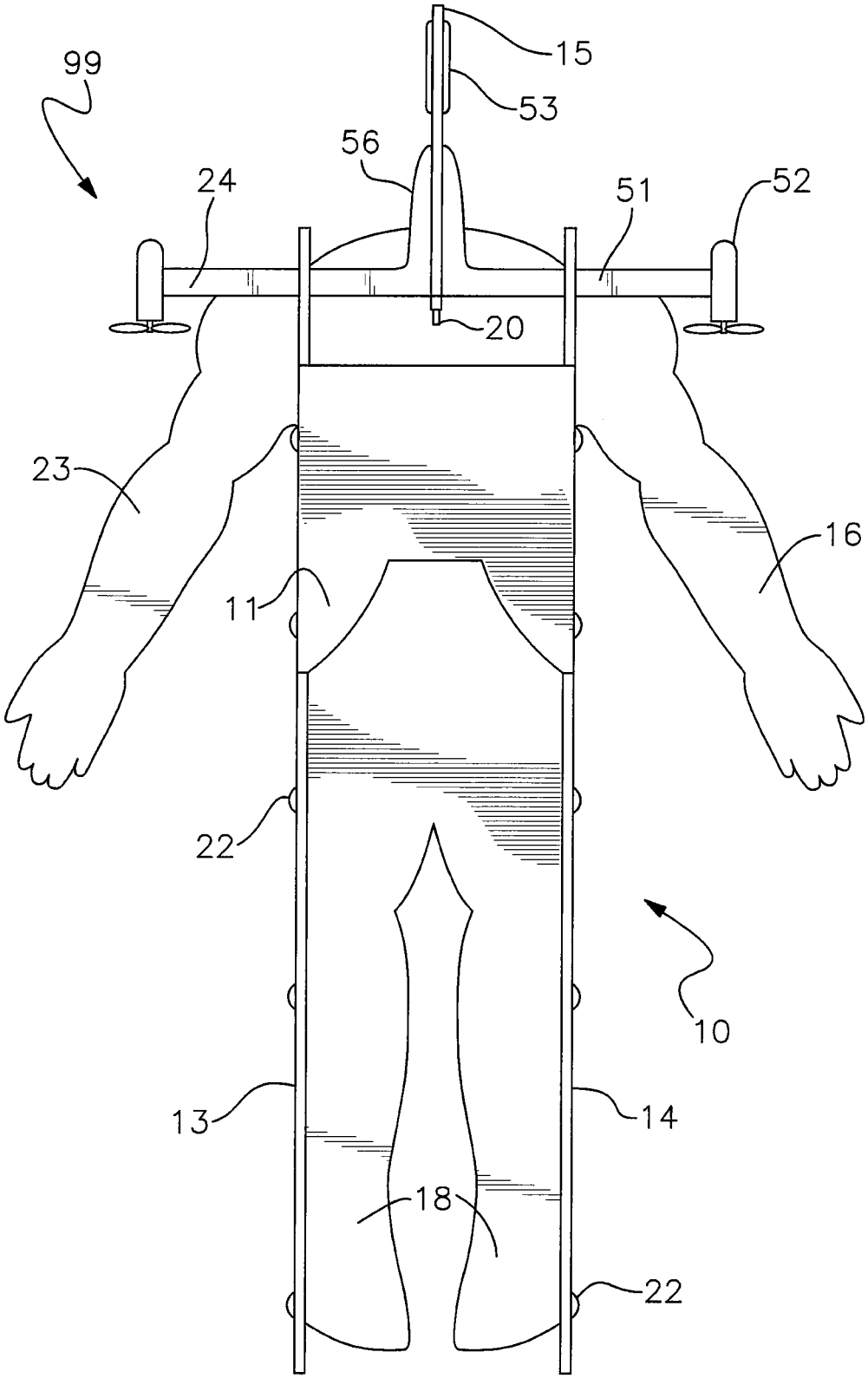
FIG. 2 is a bottom view of one embodiment of the remote controlled flying toy figure.
Figure 3:
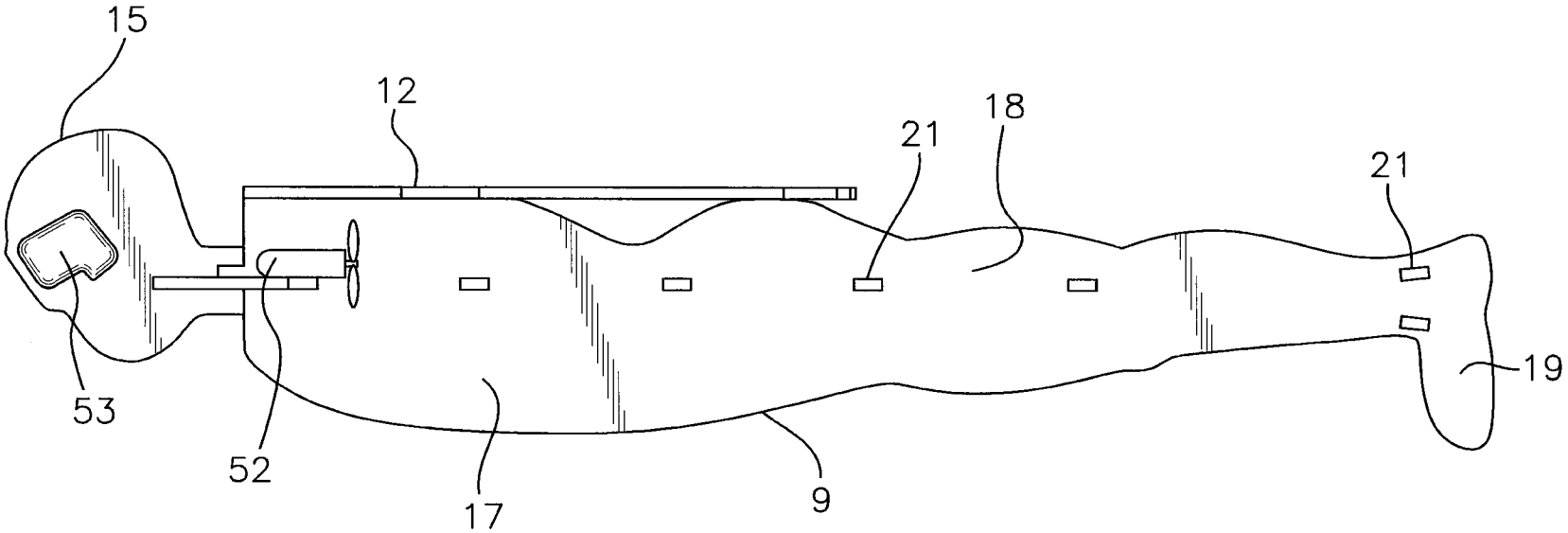
FIG. 3 is an elevation view of one embodiment of the flying toy figure.

Referring to FIGS. 1-3, the flying toy figure 99 comprises a head 15, a steering bar 51, a body 10, a propulsion system 50, and a control system 53. The flying toy figure 99 preferably takes the form of a recognizable shape, such as the general form of a super hero, a human, an animal, an automobile, or the like. For the purposes of this discussion, and by way of example and not limitation, the flying toy figure 99 will be discussed herein as taking the generalized form of a human.

The head 15 is generally the nose of the flying toy figure 99, and the head 15 can take on many shapes. In one exemplary embodiment, the head 15 is a conical member or shaped in the form of an air foil, depending on the aerodynamic effect desired to be produced. In another embodiment, the head 15 is a flat panel, which serves as a rudder-type member at a forward position of the flying toy figure 99, as discussed below. In this embodiment, the head 15 is oriented vertically with respect to the body 10, which is generally oriented in a plane horizontal to the ground. The steering bar 51 is securely attached to the head 15 such that the head 15 and steering bar 51 move as a single unit. Optionally, the connection between the head 15 and steering bar 51 can comprise stiffening members 56 to strengthen the connection between these respective members.

The body 10 generally comprises one or more wing members 8 such as bottom wings 11, a top wings 12, lateral wings 23, and intermediate wings 25. The body 10 also comprises one or more side members 9, such as a first side panel 13, and a second side panel 14. In one exemplary embodiment, to provide additional lift the body 10 comprises arms 16 configured into the shape of lateral wings 23, or one or more intermediate wings 25 located between the bottom wing 11 and top wing 12. The lateral wings 23 are either separately attached to the body 10, or they are integrated with the top wing 12 to form a single unit. The lateral wings 23 are attached to the body 10 either in-plane with the top wing 12, or at a dihedral angle to the top wing 12.

The first and second side panels 13, 14 are configured to portray the shape of the figure. When the figure 99 takes the form of a superhero, the first and second side panels 13, 14 are configured in a shape generally portraying the torso 17, legs 18, and feet 19 of the superhero. The bottom and top wings 11, 12 and the side panels 13, 14 and head 15 are made of cardboard, foam board, plastic sheets, lightweight wood such as balsa, or other suitable material typically used to make flying toys.

In one embodiment, the top wing 12, bottom wing 11, and side panels 13, 14 form the generalized cross section of a box with corners that are perpendicular or close thereto. The first and second side panels 13, 14 are attached to the bottom and top wings 11, 12 by conventional means such as gluing, taping, or the like. In another embodiment of the manner of connection, the bottom and top wings 11, 12 and any intermediate wings 25 are fabricated with insertion tabs 22 which are inserted into corresponding slots 21 in the first and second side panels 13, 14. Additional glue, tape, or the like can be used to further retain the tabs 22 inside the slots 21. As an example of this embodiment, the body 10 comprises one or more wing members 8 and one or more side panels 11, 12, and at least one of said one or more wing members 8 is configured in the shape of legs of the toy figure 99 and has insertion tabs 22 on these legs. At least one of the side panels 11, 12 is configured in the shape of legs 18 and feet 19 of the toy figure 99, and the feet 19 have a plurality of slots 21 for receiving the insertion tabs 22. The insertion tabs 22 are inserted into the slots 21 at the desired location. The selection of these slots 21 changes the curvature of the legs on the wing member 8, thus changing the pitch of the flying toy figure 99 during flight, as described below.

In some embodiments, the bottom and top wings 11, 12 and the side panels 13, 14 are connected at angles other than perpendicular to form other cross sectional shapes, such as trapezoids, pentagons, curved or contoured shapes, or the like. The cross sectional configuration of the figure 99 depends on the type of figure being portrayed, and the desired aerodynamic properties of the figure 99 during flight. An ordinary practitioner will understand that dozens of cross sectional configurations of the body can be implemented as desired.

In many embodiments of the flying toy figure 99, the body 10 will have a generally elongated form, such as the torso of a superhero. In these embodiments, it is desirable to provide a combination of wing members 8 and side members that form a generally closed cross section to provide torsional stiffness to the body 10. This torsional stiffness provides rigidity to the body, which translates into better control and maneuverability of the flying toy figure 99. Other embodiments of the body 10 can have an open cross section, such as in the shape of an "H", where a wing member 8 forms the cross member of the "H," and side members 9 form the vertical members of the "H." This configuration may be more desirable for certain embodiments of the flying toy figure 99, or as a manner of producing a low cost version of a flying toy figure 99.

Figure 4:
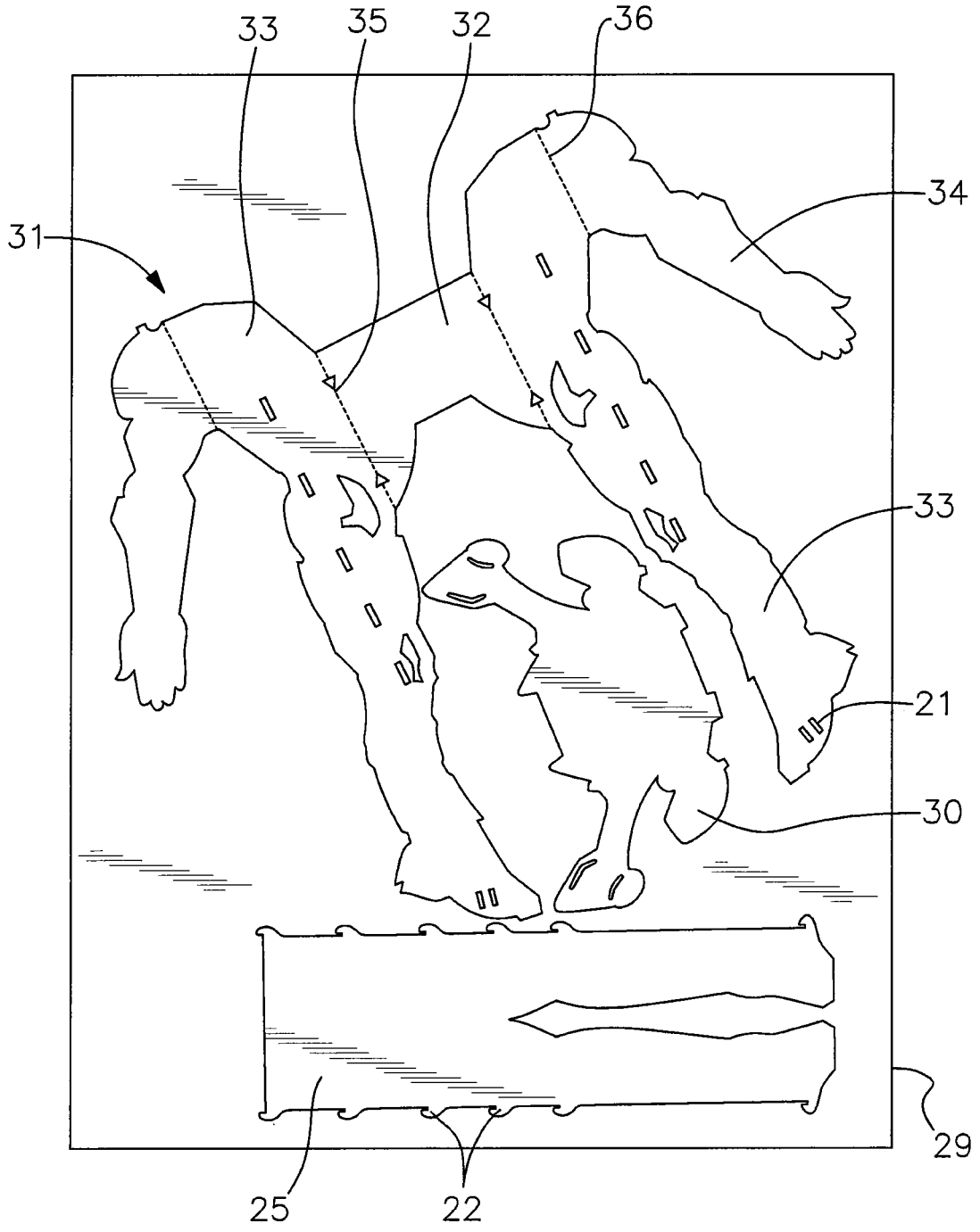
FIG. 4 shows the cutout patter for the five-piece body of one embodiment of the remote controlled flying toy figure.

For ease of manufacturing, it is convenient for the body 10 to be stamped out of a single sheet 29 of material, as shown in FIG. 4. The sheet 29 is typically a single sheet 29 of foam board, cardboard, or other sheet material for constructing the body 10. This manufacturing method allows certain sections of the body 10 to be joined by folds in the sheet 29, as opposed to relying on more difficult joints, such as by tape or glue. Consequently, in the embodiment of the body 10 shown in FIG. 4, the body 10 has a top member 30 and a base member 31 cut or stamped out of the sheet 29. The base member 31 has a 5-section foldable configuration comprising a middle section 32, two transitional sections 33, and two exterior sections 34. The two transitional sections 33 are joined to opposite sides of the middle section 32 along transitional/middle fold lines 35. Each of the two exterior sections 34 are joined to one of the transitional sections 33 on the side of the transitional section 33 opposite that of the middle section 32, and each of the exterior sections 34 are joined to the transitional section 33 along an exterior/transitional fold line 36. To form the body 10, the base member 31 is folded at the transitional/middle fold lines 35 so that the middle section 32 forms a bottom wing 11 of the body 10, and the transitional sections 33 form side members 13, 14 of the body 10. The base member 31 is then folded at the exterior/transitional fold lines 36 such that the exterior sections 34 form lateral wings 23 extending laterally from the body 10. The top member 30 is then joined to the base member 31 such that the top member 30 forms a top wing 12 of the body 10. The remaining body 10 pieces and joints are then formed and secured according to the teachings of the previous embodiments of the body 10 discussed above.

Figure 5:
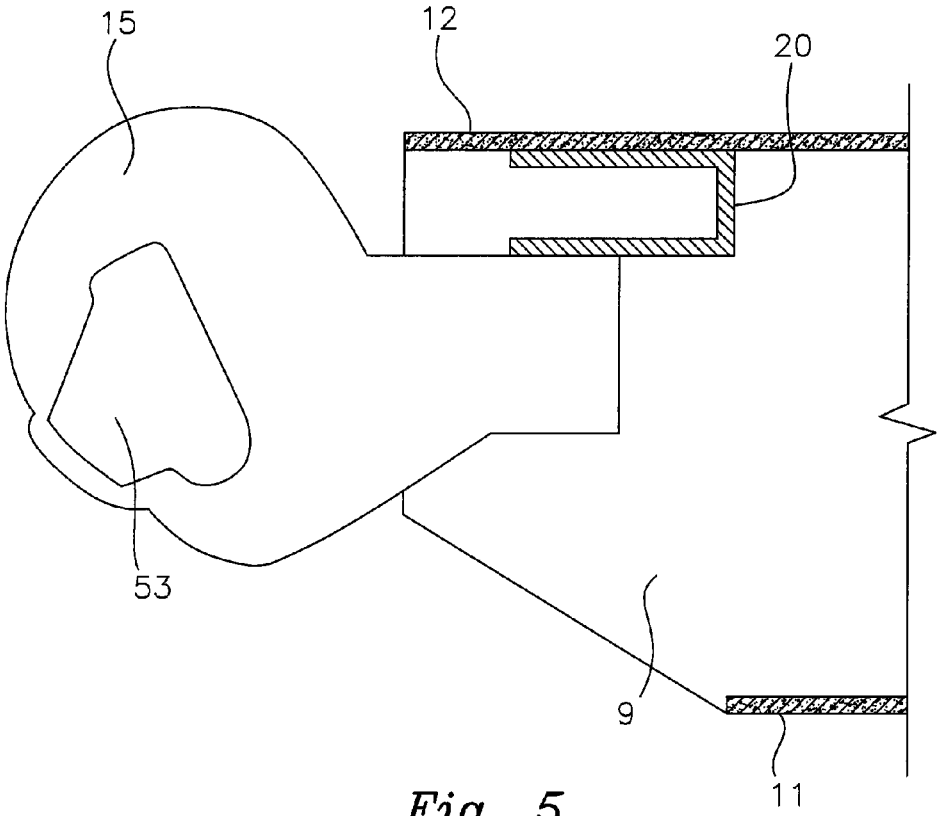
FIG. 5 is a sectional view showing the support member and the left side of the head of the flying toy figure.
Figure 6:
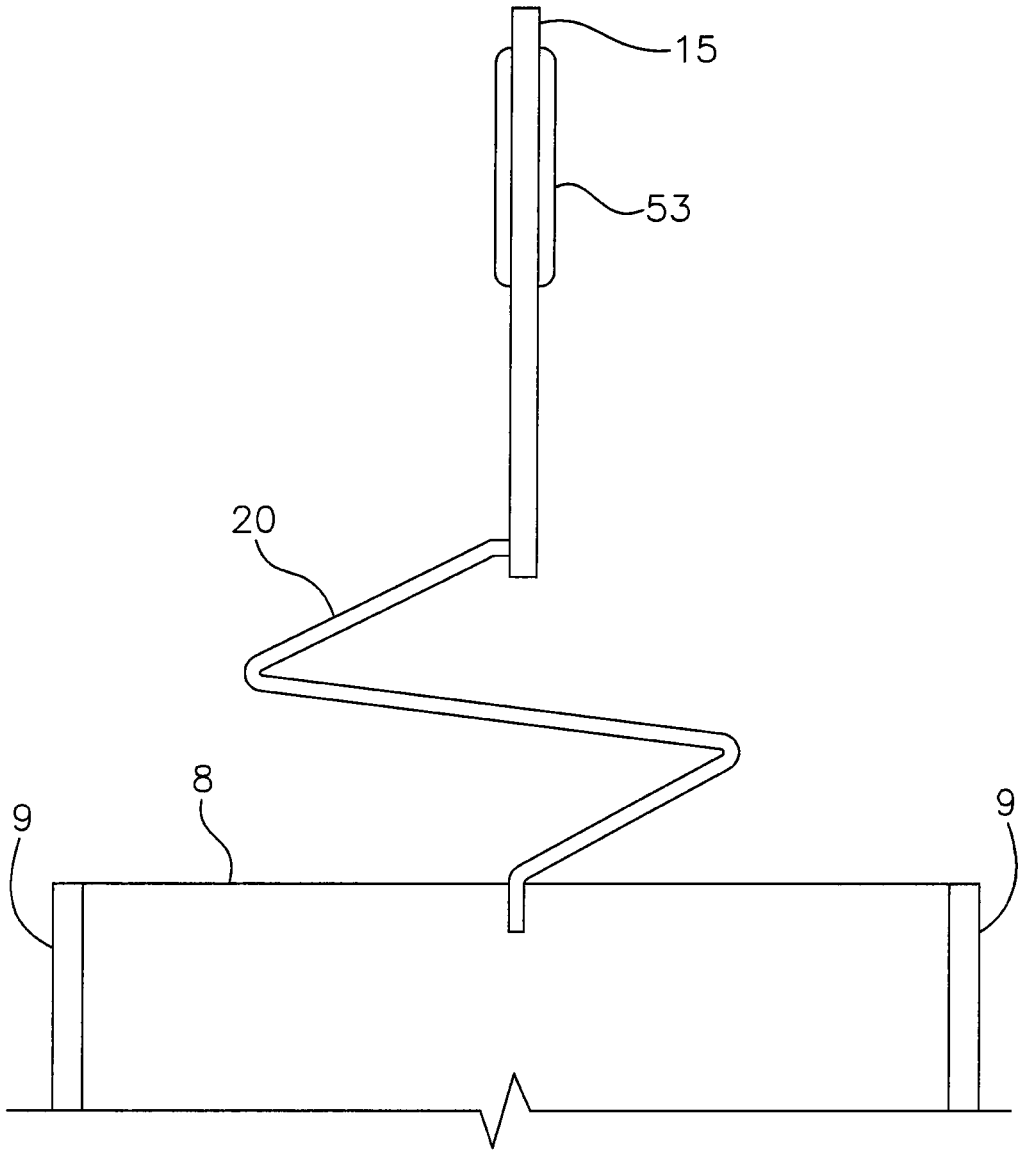
FIG. 6 is a partial view of the flying toy figure showing one embodiment of the flexible support member.

As shown in FIG. 5, the head 15 of the figure 99 is connected to the body 10 by a flexible support member 20. For example, the flexible support member 20 could be a wire or other resilient member attaching the body 10 to the head 15. In one embodiment, the support member 20 is a wire or thin rod to which the head 15 and body 10 are attached. Other embodiments of the flexible support member 20 may comprise a system of springs, wires, or other flexible or elastic members to resiliently connect the body 10 to the head 15. As one example, shown in FIG. 6, the flexible support member 20 is oriented in a zig-zag shape to promote flexibility of the overall member. Generally, the support member 20 is attached to the body 10 at the top wing 12, the bottom wing 13, or another convenient location, depending on the configuration of the figure 99 and the body 10. In most configurations, the support member 20 is attached to the top wing 12. The support member 20 is attached to the head 15 and body 10 by tape, glue, mechanical anchor, or other suitable means.

In some instances, the figure 99 may land by impacting the ground or other object first with the head 15, and then with the body 10. In these instances of head-first impact, the head 15 absorbs the majority of the force from impact. In prior art flying toys, the head or other leading member of the figure is rigidly connected to the body, and these components tend to break apart under the severe force created by head-first impact. The flexible support member 20 of the present figure 99 provides superior performance in these head-first landings because the flexible support 20 flexes to absorb the severe impact force. For example, the support member 20 could comprise a lateral arm 30 that extends horizontally along the body 10, and the distal end of the arm 30 is secured to the body 10. The remainder of the arm 30 and support member 20 remain free-floating to provide flexibility. In this manner, upon head-first impact the horizontal arm 30 flexes to absorb the impact force, thereby protecting the head and body from impact-related damage.

Figure 7:
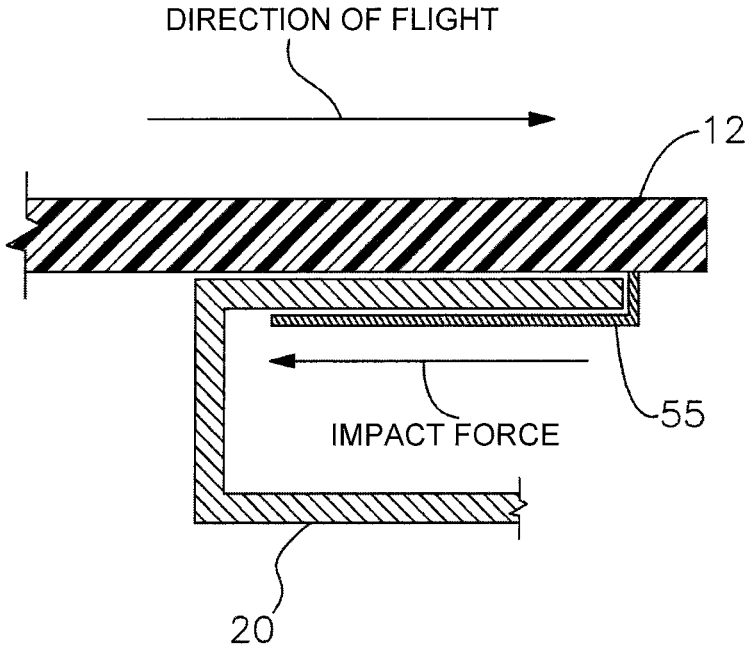
FIG. 7 is a sectional view showing one embodiment of the connection between the flexible support member and the body of the flying toy figure.

In another embodiment, shown in FIG. 7, to further absorb the head-first impact force, the support member 20 is attached to the body 10 via a receptacle 55 or other releasable attachment from which the support member 20 is dislodged upon impact. As an example of this embodiment, the support member 20 is a wire and the receptacle 55 is a tube-like member attached to the bottom side of the top wing 11 a mechanical anchor, or by glue, tape, epoxy, or the like. This tube-like receptacle 55 is sized such that the support member 20 wire is snugly insertable into the receptacle 55. During normal operation the support member 20 is retained inside the receptacle 55 by surface friction between the two members. During a head-first impact event, if the force from the impact exceeds the surface friction force, the support member 20 is dislodged from the receptacle 55, thereby separating the head 15 and steering bar 51 unit (described below) from the body 10. This releasable connection between the head 15 and the body 10 reduces the instances in which the head 15 or body 10 sustains damage during head-first impact. Other releasable attachments 55 could be used for the same purpose, such releasable attachments 55 being bonding agents or adhesive bonds that break under a predetermined force, or breakable or releasable members such as clips, clamps, ties, or the like.

Referring again to FIGS. 1-3, the propulsion system 50 generally comprises a plurality of propulsion units 52. The most common embodiment of the propulsion units 52 is an electrical motor driving a propeller. In embodiments of the propulsion system 50 having two propulsion units 52, each of the propulsion units 52 is attached to opposite ends of the steering bar 51. The power delivered by the motors and the size and shape of the propellers is a matter of design choice, and these components of the propulsion units 52 are selected in proportion to the other aerodynamic properties of the flying toy figure 99. The propulsion units 52 are independently operable, meaning that the thrust produced by one of the propulsion units 52 is greater than that of the other propulsion unit 52.

The propulsion system 50 can comprise more than two propulsion units 52. For example, the propulsion system 50 can comprise two propulsion units 52 attached to the steering bar 51 adjacent to one side of the head 15, and two propulsion units 52 attached to the steering bar 51 adjacent to the opposite side of the head 15, for a total of four propulsion units 52. Alternately, the flying toy figure 99 could have two steering bars 51 attached to the head 15, with one steering bar 51 above the other. Each of these steering bars 51 could support two propulsion units 52 attached at opposite ends of the steering bar 51, for a total of four propulsion units 52.

In any of the embodiments of the steering bar 51, the steering bar 51 can take the shape of an airfoil or a wing such that the steering bar 51 operates as a front wing 24 during flight, thereby creating an additional lift force for the flying toy figure 99.

The control system 53 comprises the electronic components for operation of the remote controlled toy figure 99. The control system 53 typically comprises a receiver, a power source such as a battery, a circuit board, and other electronic components and wiring necessary to create electrical connectivity between the receiver, power source, and the propulsion units 52. In most embodiments, the control system 53 comprises components that are common in the RC toy industry. The main components of the control system 53 are attached to the flying figure 99 by tape, glue, screws, clips, or other suitable attachment material or device. In any of the embodiments of the steering bar 51, the bar 51 could be hollow, thereby acting as a conduit for the passage of electrical wires between the control system 53 and at least one of the propulsion units 52.

Figure 10:
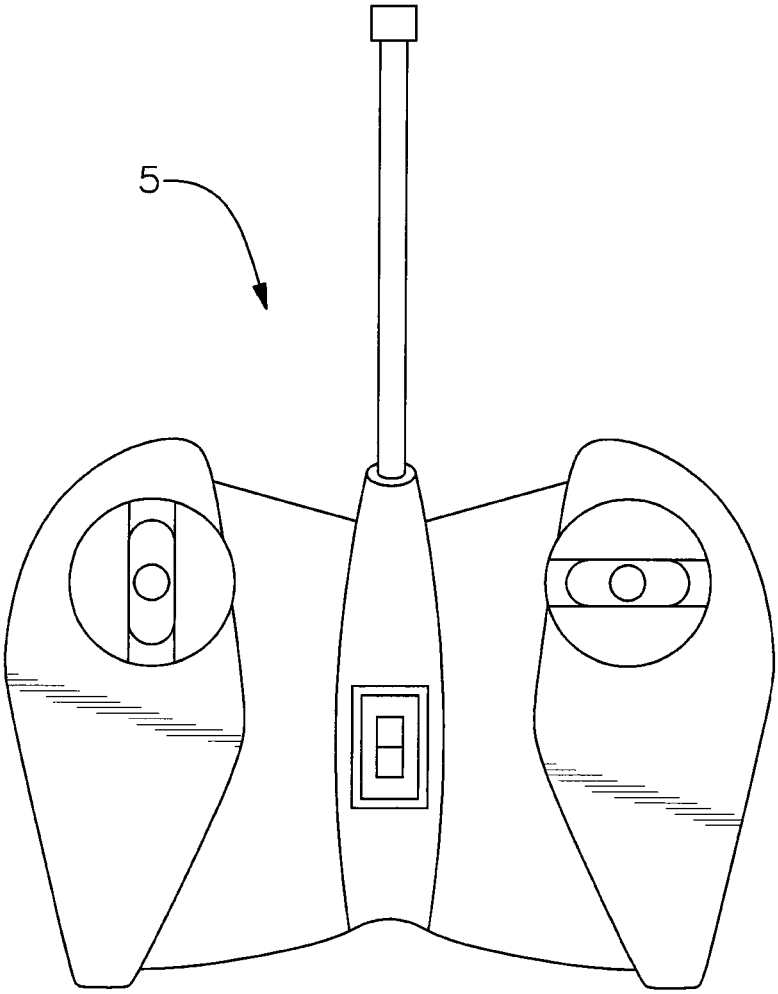
FIG. 10 shows one embodiment of a wireless control device.

In one embodiment of the operation of the flying toy figure 99, the propulsion units 52 are independently driven to promote a greater degree of steering and control by the user. For example, the user uses the wireless control device 5 (shown in FIG. 10) to send a signal to the receiver of the control system 53 to allocate more power to one of the two propulsion units 52, thereby creating a thrust differential between the respective propulsion units 52. This increase in power causes an increase in thrust produced by the over powered propulsion unit 52, thereby producing greater thrust on one side of the body 10. This thrust differential forces the figure 99 to turn to in the opposite direction. For example, to make a turn to the right, the control system 53 allocates more power to the left propulsion unit 52, thereby creating greater thrust on the left side of the body 10 and forcing the figure 99 to turn to the right. A corresponding left turn is produced by producing more thrust from the right propulsion unit 52 than from the left.

Figure 8:
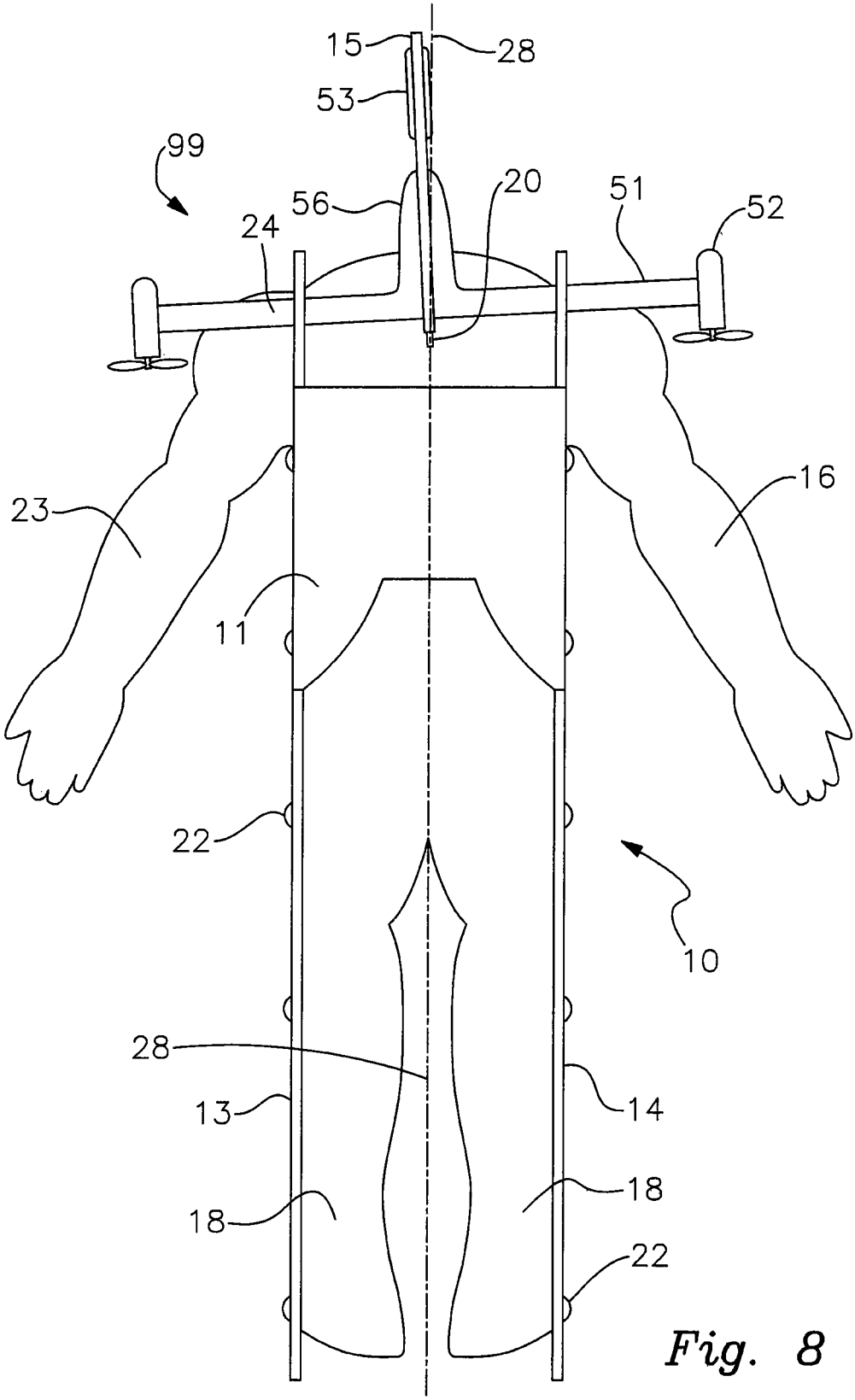
FIG. 8 is a bottom view of the steering bar yawing in one direction in relation to the body of the flying toy figure.

Referring to FIG. 8, the head 15 moves in a yawing motion in relation to the body 10 as the figure 99 turns. More specifically, since the head 15 is attached to the body 10 by a flexible support member 20, and since the head 15 and steering bar are attached in flexible relation to the body 10, the head 15 and steering bar 51 will turn to the right in a yawing motion when the left propulsion unit 52 produces greater thrust than the right propulsion unit 52. Likewise, the head 15 and steering bar 51 will turn to the left in a yawing motion when the thrust of the right propulsion unit 52 is greater than that of the left propulsion unit 52. Thus, the head 15 acts as a rudder positioned at the front of the figure 99, providing a forward steering mechanism that enables sharper turning of the figure 99 and more precise control by the operator. The head 15 and steering bar 51 move as a rigid unit in a yawing motion in relation to the body 10. Depending on the configuration of the body 10, it may be desirable to install steering slots 54 in the body 10 to accommodate free motion by the steering bar 51, ensuring that the yawing motion of the steering bar 51 remains unobstructed by the close proximity of the body 10.

The steering sensitivity of the rudder head 15 can be manipulated by the shape of the head 15. For example, a relatively blunt head in the shape of a nose cone will produce a soft rudder effect and a correspondingly soft steering response. By contrast, a thin, flat rudder head 15 oriented vertically with respect to the body 10 will produce a sharper rudder effect and a correspondingly sharper steering response. Consequently, the shape of the rudder head 15 affects the overall maneuverability and agility of the flying toy figure 99. Prior art flying toys are prone to many types of control and maneuverability deficiencies.

To reduce these undesirable effects caused by these deficiencies, one embodiment of the present figure 99 places the location of all or part of the control system 53 on the head 15. The portion of the control system 53 attached to the head 15 adds additional weight to the head 15. During the steering operation, the yawing, or turning, capability of the head 15 and steering bar 51 unit causes the center of gravity of the head 15 to move off-center with respect to the body's 10 center of gravity, which corresponds approximately with the longitudinal axis 28 of the flying toy figure 99. When the center of gravity of the head 15 moves off-center, the figure 99 will bank in the direction of the turn. For example, when the left propulsion unit 52 provides increased thrust, the head 15 and its center of gravity are moved to the right of the figure's 99 longitudinal axis 28 (approximate center of gravity), thus causing the figure 99 to bank to the right as the figure 99 turns to the right. The reverse motions occur for turns to the left. This banking motion provides greater aerodynamic control over the figure 99 during its flight. The weight-shifting rudder head 15 can be further streamlined by enclosing the mounted control system 53 components inside a nacelle on the head 15.

In another embodiment of the weight-shifting rudder head 15, all or part of the control system 53 is attached to the steering bar 51. In this embodiment, the weight-shifting effect of the rudder head 15 is less pronounced, but remains in effect. Specifically, placing all or part of the control system 53 on the steering bar 51 moves those components of the control system 53 closer to the point where the flexible support member 20 anchors to the body 10. As a result, the yawing motion of the head 15 relative to the body 10 moves the center of gravity a small distance away from the center of gravity of the flying toy figure 99, thus reducing the banking effect caused by the weight-shifting action.

To further adjust the aerodynamic properties, appearance, and control of the figure 99, the bottom and top wings 11, 12 and the side panels 13, 14 can be adjusted in relation to each other. In one embodiment, for example, each side panel 13, 14 comprises a set of slots 21 such that the insertion tabs 22 of the bottom wing 11 can be attached to the side panels 13, 14 at various orientations. An example of this configuration is shown in FIGS. 1, 2, 4, wherein the feet 19 of the side panels 13, 14 have various slots 21 for receiving the insertion tabs 22. The aerodynamic properties of the toy figure 99 change depending on which slots 21 the tabs 22 are inserted into. When the tabs 22 are inserted into the bottom slots 21, the figure 99 is oriented in a substantially horizontal position during flight. When the tabs 21 are inserted into the top slots 21, the figure 99 will appear more upright during flight. In this manner, the user can adjust the pitch of the body 10 during flight, and therefore the appearance portrayed by the figure 99 by selecting a certain set of slots 21 in which to insert the tabs 22 in the feet 19 or in other places along the side panels 13, 14.

Figure 9:
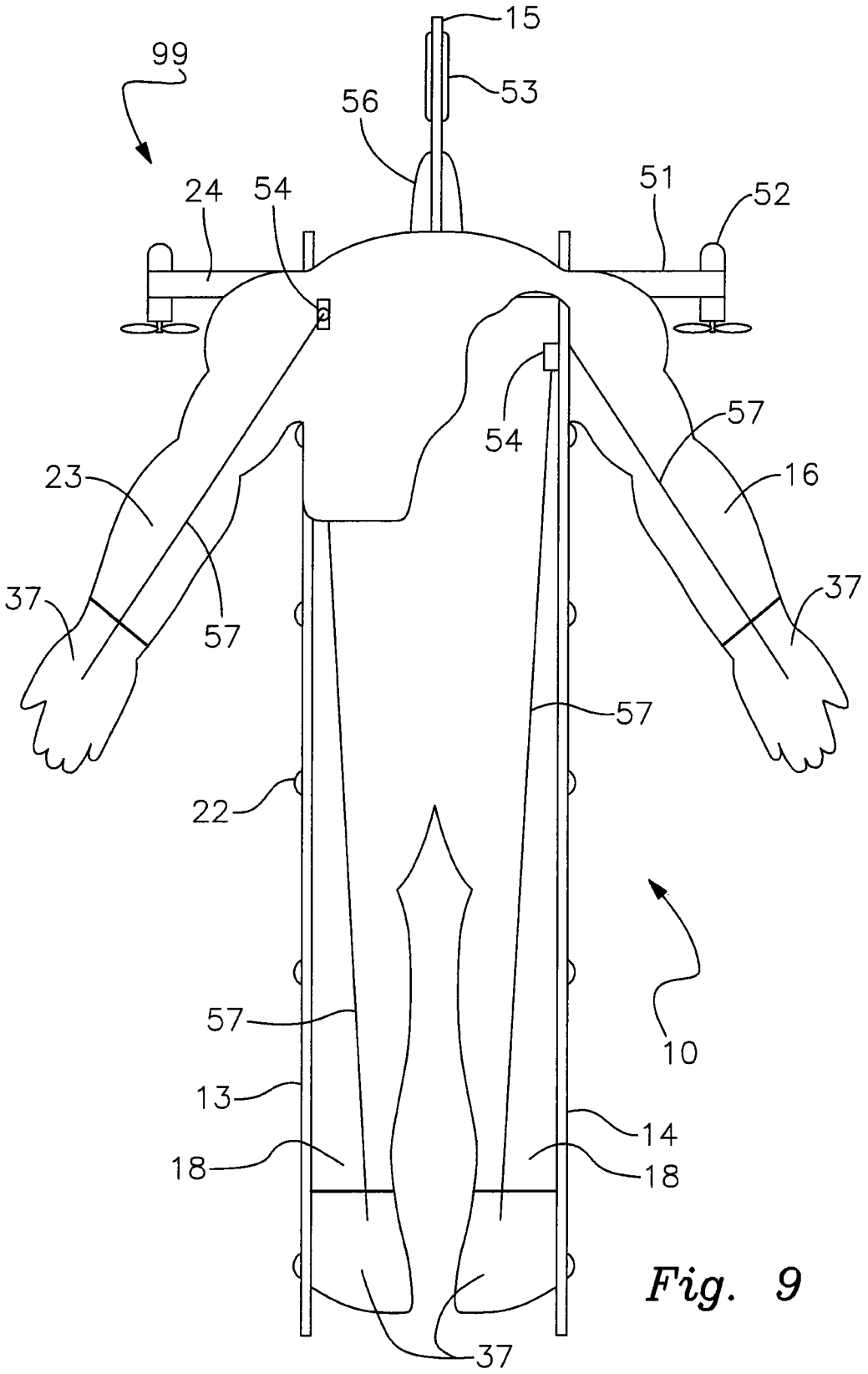
FIG. 9 is a top view of one embodiment of the flying toy figure wherein the top wing is partially cut away to reveal the servo connectivity for the flying toy figure.

In another embodiment shown in FIG. 9, the arms 16, or lateral wings 23, are fitted with ailerons, tabs, flaps, or other devices to adjust the aerodynamic properties of the arm 16 during flight. In embodiments where the figure 99 takes the form of a human or other two-legged figure, each leg portion 23 of the bottom wing 11 forms a flap or elevator 37 that serve to provide additional in-flight controlling mechanism. These elevators 37 are located at an aft portion of the body 10. In these embodiments, the body 10 comprises one or more servo motors 54 that are configured for controlling the movement and maneuvering the legs 23 in an up or down motion to assist in controlling the flight of the figure 99. The servos 54 can also be used to control the movement of the lateral wings 23 to produce an additional aerodynamic controlling effect for the flying toy figure 99. The servos 54 can be configured to control only the elevators 37, only the lateral wings 23, or both. The servos 54 are connected to the elevators 37 by actuating members 57, which are rods for pushing or pulling the elevators 37, or strings for pulling the elevators 37. The operation of the servos 54 is controlled by the control system 53.

In another embodiment, the head 15 or body 10 comprises lights positioned at various locations to portray a certain decorative design or a desired visual effect during flight. For example, the feet 19 can comprise lights that depict fire emitting from the feet of a flying superhero. The lights are powered and controlled by the control system 53.

The foregoing embodiments are merely representative of the flying toy figure and not meant for limitation of the invention. For example, one having ordinary skill in the art would understand that there are several embodiments and configurations of wing members 8, connection members, or support members that will not substantially alter the nature of the flying toy figure. Consequently, it is understood that equivalents and substitutions for certain elements and components set forth above are part of the invention described herein, and the true scope of the invention is set forth in the claims below.

I claim:

1. A flying toy figure comprising:

a head;

a body shaped in the form of a human, said body connected to the head, and said body comprising a bottom wing defining a chest of the body, a top wing defining a back of the body, lateral wings defining arms of the body, said body further comprising a first side panel and a second side panel, said first side panel and said second side panel connected to the bottom wing and the top wing in a manner forming a box-like cross section of the body;

a propulsion system having a first propulsion unit and a second propulsion unit, the first propulsion unit being connected to the flying toy figure at a location to the left of a longitudinal axis of the flying toy figure, and the second propulsion unit being connected to the flying toy figure to the right of the longitudinal axis of the flying toy figure; and a control system for controlling the propulsion system, said control system configured to receive electronic signals from a wireless control device.

2. The flying toy figure of claim 1, wherein the first and second propulsion units are independently operable, thereby enabling the first and second propulsion units to create a thrust differential between them, said thrust differential promoting maneuverability of the flying toy figure.

3. The flying toy figure of claim 2, wherein the body further comprises an intermediate wing disposed between the bottom wing and the top wing, said intermediate wing defining legs of the body.

4. The flying toy figure of claim 2, wherein at least part of the control system is attached to the head, thereby forming a weight shifting rudder head.

5. The flying toy figure of claim 2, wherein the lateral wings are configured at a dihedral angle, thereby promoting aerodynamic stability of the flying toy figure.

6. The flying toy figure of claim 1, wherein the body further comprises an intermediate wing disposed between the bottom wing and the top wing, said intermediate wing defining legs of the body.

7. The flying toy figure of claim 6, wherein at least part of the control system is attached to the head, thereby forming a weight shifting rudder head.

8. The flying toy figure of claim 1, wherein at least part of the control system is attached to the head, thereby forming a weight shifting rudder head.

9. The flying toy figure of claim 1, wherein the first side panel and the second side panel are configured to depict a torso, legs, and feet of the flying toy figure.

10. The flying toy figure of claim 1, wherein the lateral wings are configured at a dihedral angle, thereby promoting aerodynamic stability of the flying toy figure.

11. A flying toy figure comprising:

a head;

a body shaped in the form of a human, said body connected to the head, and said body comprising:

(a) a bottom wing defining a chest of the body;

(b) a top wing defining a back of the body;

(c) lateral wings defining arms of the body;

(d) an intermediate wing disposed between the bottom wing and the top wing, said intermediate wing defining legs of the body;

(e) a first side panel and a second side panel, said first side panel and said second side panel connected to the bottom wing and the top wing in a manner forming a box-like cross section of the body;

wherein the intermediate wing further comprises insertion tabs, and the first side panel and second side panel further comprise slots for receiving said insertion tabs, and wherein the intermediate wing is connected to the first side panel and the second side panel by inserting the insertion tabs into said slots;

a propulsion system having a first propulsion unit and a second propulsion unit, the first propulsion unit being connected to the flying toy figure at a location to the left of a longitudinal axis of the flying toy figure, and the second propulsion unit being connected to the flying toy figure to the right of the longitudinal axis of the flying toy figure; and a control system for controlling the propulsion system, said control system configured to receive electronic signals from a wireless control device.

12. The flying toy figure of claim 11, wherein the first and second propulsion units are independently operable, thereby enabling the first and second propulsion units to create a thrust differential between them, said thrust differential promoting maneuverability of the flying toy figure.

13. The flying toy figure of claim 12, wherein at least part of the control system is attached to the head, thereby forming a weight shifting rudder head.

14. The flying toy figure of claim 12, wherein the first side panel and the second side panel are configured to depict a torso, legs, and feet of the flying toy figure.

15. The flying toy figure of claim 12, wherein the lateral wings are configured at a dihedral angle, thereby promoting aerodynamic stability of the flying toy figure.

16. The flying toy figure of claim 11, wherein at least part of the control system is attached to the head, thereby forming a weight shifting rudder head.

17. The flying toy figure of claim 13, wherein the lateral wings are configured at a dihedral angle, thereby promoting aerodynamic stability of the flying toy figure.

18. The flying toy figure of claim 11, wherein the first side panel and the second side panel are configured to depict a torso, legs, and feet of the flying toy figure.

19. The flying toy figure of claim 18, wherein the lateral wings are configured at a dihedral angle, thereby promoting aerodynamic stability of the flying toy figure.

20. The flying toy figure of claim 11, wherein the lateral wings are configured at a dihedral angle, thereby promoting aerodynamic stability of the flying toy figure.

* * * * *